US008769764B2

(12) United States Patent
Crouch et al.

(10) Patent No.: US 8,769,764 B2
(45) Date of Patent: Jul. 8, 2014

(54) HAND-HELD AND CONVERSION VACUUM CLEANER WITH ADAPTER

(75) Inventors: James Todd Crouch, Danville, KY (US); Shawn M. Smith, Lancaster, KY (US); Julio C. Leguen-Perez, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 690 days.

(21) Appl. No.: 13/040,551

(22) Filed: Mar. 4, 2011

(65) Prior Publication Data

US 2012/0030896 A1 Feb. 9, 2012

Related U.S. Application Data

(60) Provisional application No. 61/370,897, filed on Aug. 5, 2010.

(51) Int. Cl.
*A47L 5/00* (2006.01)
*A47L 9/00* (2006.01)

(52) U.S. Cl.
USPC ..... 15/328; 15/329; 15/246.2

(58) Field of Classification Search
USPC ..... 15/344, 328, 329, 331, 334, 335, 246.2, 15/DIG. 1
IPC ..... A47L 5/00,9/00
See application file for complete search history.

(56) References Cited

U.S. PATENT DOCUMENTS

| | | | | |
|---|---|---|---|---|
| 4,175,352 | A | 11/1979 | Catlett | |
| 4,188,081 | A | 2/1980 | Holden et al. | |
| 4,211,457 | A | 7/1980 | Meadows | |
| 4,316,304 | A | 2/1982 | Parise et al. | |
| 4,385,790 | A | 5/1983 | Genoa | |
| 4,473,923 | A | 10/1984 | Neroni et al. | |
| 4,573,237 | A | 3/1986 | Kochte et al. | |
| 4,634,197 | A | 1/1987 | Horlacher, Jr. | |
| 4,635,315 | A | 1/1987 | Kozak | |
| 4,639,055 | A | 1/1987 | Keane | |
| 4,928,346 | A | 5/1990 | Elson et al. | |
| 4,963,100 | A | 10/1990 | Genoa et al. | |
| 5,309,600 | A | 5/1994 | Weaver et al. | |
| 5,337,443 | A | 8/1994 | Steinberg et al. | |
| 5,652,996 | A | 8/1997 | Moine et al. | |
| 5,992,423 | A * | 11/1999 | Tevolini | 132/200 |
| 6,122,796 | A | 9/2000 | Downham et al. | |
| 6,434,785 | B1 | 8/2002 | Vandenbelt et al. | |
| 6,839,934 | B2 | 1/2005 | Houghton et al. | |
| 7,135,051 | B2 | 11/2006 | Baldinger et al. | |
| 7,159,270 | B2 | 1/2007 | Genoa et al. | |
| 7,168,127 | B2 | 1/2007 | Genoa et al. | |
| 7,171,724 | B2 | 2/2007 | Gollegot et al. | |
| 7,275,279 | B2 | 10/2007 | Genoa et al. | |
| 7,412,749 | B2 | 8/2008 | Thomas et al. | |
| 2003/0106180 | A1 * | 6/2003 | Tsen | 15/321 |
| 2007/0163075 | A1 | 7/2007 | Butler et al. | |
| 2007/0271724 | A1 | 11/2007 | Hakan et al. | |
| 2008/0209666 | A1 | 9/2008 | Conrad | |
| 2009/0276974 | A1 | 11/2009 | Khalil et al. | |
| 2010/0083459 | A1 | 4/2010 | Beskow et al. | |

* cited by examiner

*Primary Examiner* — David Redding
(74) *Attorney, Agent, or Firm* — King & Schickli, PLLC

(57) ABSTRACT

A hand-held and conversion vacuum cleaner includes a housing carrying a suction generator, a dirt collection vessel and a suction inlet. A first connector is carried on the housing. The first connector secures the suction inlet in fluid communication with a first cleaning attachment. The vacuum cleaner also includes an adapter having a second connector that secures the suction inlet in fluid communication with a second cleaning attachment.

19 Claims, 10 Drawing Sheets

HAND-HELD AND CONVERSION VACUUM CLEANER WITH ADAPTER

This application claims the benefit of U.S. Provisional Patent Application Ser. No. 61/370,897 filed on 5 Aug. 2010, the entire disclosure of which is incorporated herein by reference.

TECHNICAL FIELD AND INDUSTRIAL APPLICABILITY OF THE INVENTION

The present invention relates generally to the cleaning appliance field and, more particularly, to a combined hand-held and conversion vacuum cleaner.

BACKGROUND OF THE INVENTION

There are many shapes and sizes of vacuum cleaners. Generally, however, vacuum cleaners may be divided into four categories: (1) upright vacuum cleaners; (2) stick vacuum cleaners; (3) canister vacuum cleaners and (4) hand-held vacuum cleaners. Upright vacuum cleaners generally include a nozzle assembly with a suction inlet that rides along the floor on the ground engaging wheels. The nozzle assembly is pivotally connected to a combined handle and canister assembly that carries the dirt collection vessel. The suction generator is usually carried on the canister assembly but may be carried on the nozzle assembly.

Stick vacuum cleaners are similar to upright vacuum cleaners but are significantly smaller and are lightweight. Whereas upright vacuum cleaners are meant for use in house-wide vacuum cleaning applications, stick vacuum cleaners are generally meant for small scale vacuum cleaning jobs such as vacuuming, for example, a kitchen floor.

Canister vacuum cleaners include a nozzle assembly having a suction inlet and an optional agitator as well as a separate canister assembly including the suction generator and dirt collection vessel. A cleaning wand and flexible hose are provided to connect the nozzle assembly with the canister assembly. Generally, canister vacuum cleaners are considered an alternative to upright vacuum cleaners and are used for house-wide cleaning operations. In contrast, hand-held vacuum cleaners are generally compact and lightweight. They are meant to be held in one hand and easily maneuvered to complete simple quick cleanups of limited areas or for specialty purposes such as when vacuuming an upholstered chair.

The present invention relates to a hand-held vacuum cleaner that may be easily converted into a stick vacuum cleaner. Hand-held vacuum cleaners and stick vacuum cleaners are suited for different types of cleaning applications and, accordingly, the convertibility of the vacuum cleaner enhances the versatility of the unit for use in different cleaning applications. Advantageously, the hand-held and convertible vacuum cleaner may be connected to the nozzle and wand assembly of an existing canister vacuum cleaner so as to minimize duplication of parts and provide ultimate cleaning versatility at a minimal cost.

SUMMARY OF THE INVENTION

In accordance with the purposes of the present invention as described herein, a hand-held and conversion vacuum cleaner comprises a housing. A suction generator, a dirt collection vessel, a suction inlet and a first connector are all carried on that housing. In addition, the vacuum cleaner includes an adapter. The adapter is optionally secured to the first connector. The adapter includes a second connector for securing the suction inlet in fluid communication with a second cleaning attachment.

In accordance with yet another aspect of the present invention a method of converting a hand-held vacuum cleaner to a stick vacuum cleaner is provided. The method may be broadly described as including the steps of: (a) providing the hand held vacuum cleaner with a first connector structured to engage and connect with a first type of mating connector on a first cleaning wand; (b) providing the hand held vacuum cleaner with a second connector structured to engage and connect with a second type of mating connector on a second cleaning wand; and (c) connecting the hand held vacuum cleaner to the first cleaning wand or the second cleaning wand. The method may further include the steps of: (d) providing the second connector on an adapter and (e) connecting the adapter to the first connector.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
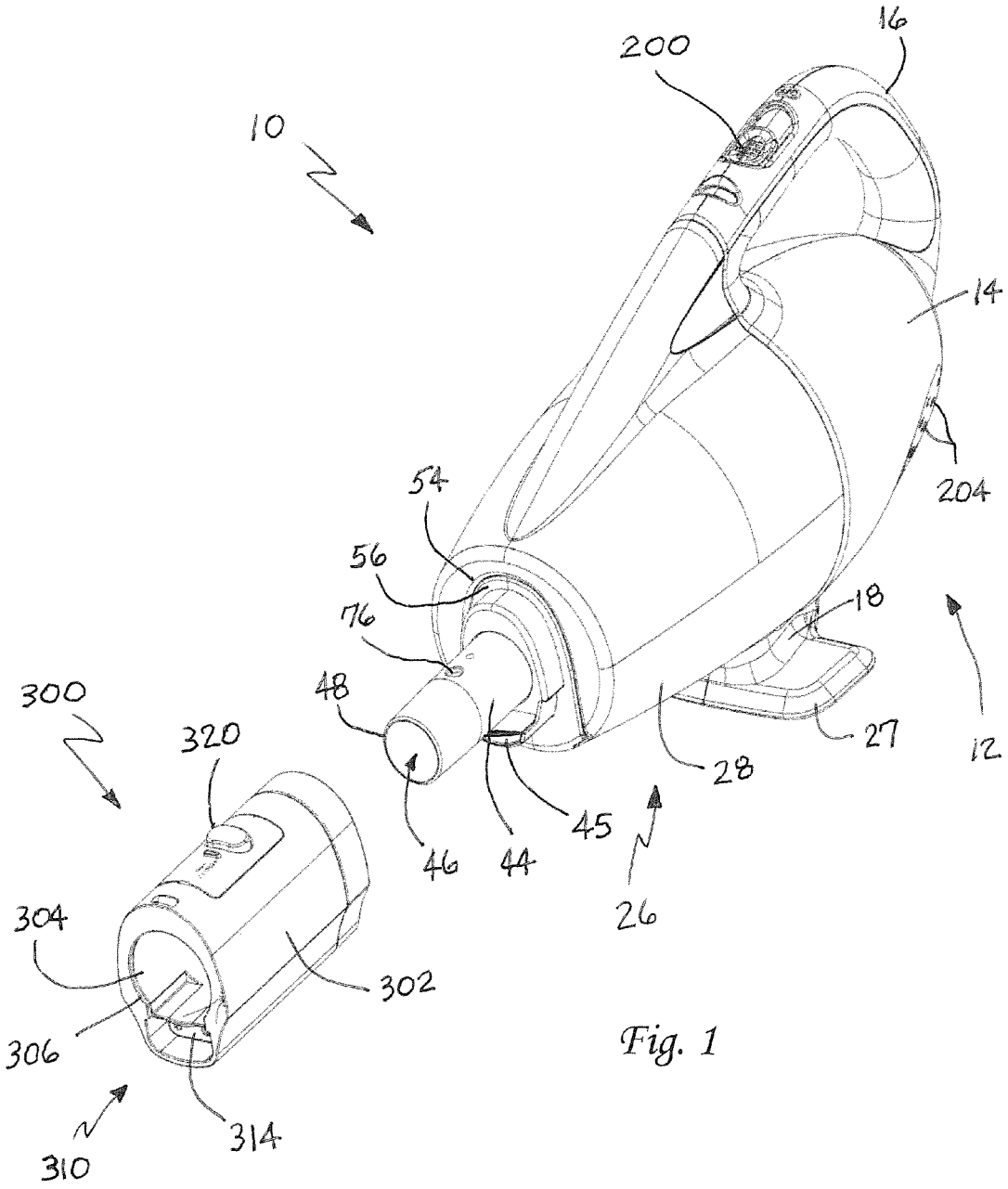
FIG. 1 is a perspective view of the vacuum cleaner of the present invention.
Figure 2:
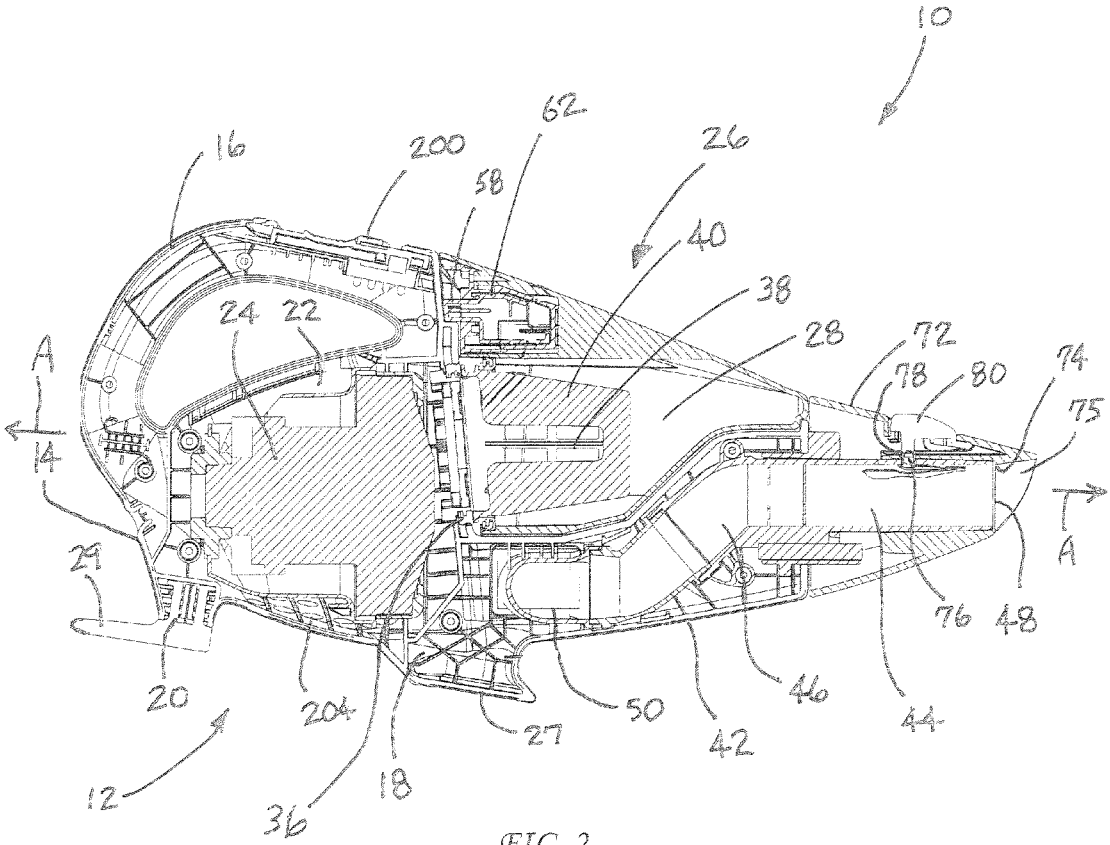
FIG. 2 is a cross sectional view of the vacuum cleaner.

Reference is now made to FIGS. 1 and 2 illustrating the hand-held and conversion vacuum cleaner 10 of the present invention. The vacuum cleaner 10 includes a housing 12 having a body 14, an integral control handle 16 and two support members 18, 20. The main body 14 of the housing 12 defines a compartment 22 receiving a suction generator 24.

As illustrated, the suction generator 24 is positioned beneath the control handle 16 as well as above and between the support members 18, 20. This is done for balance and ease of operation as will be described in greater detail below.

The vacuum cleaner 10 is powered from a standard electrical wall outlet by means of an electric cord and plug (not shown). Unlike battery powered hand held vacuum cleaners, the vacuum cleaner 10 of the present invention provides high performance cleaning suction that is sustainable indefinitely as required for virtually any cleaning application. When not in use, the cord may be wrapped around and conveniently stored on the support members 18, 20. Significantly, the feet 27, 29 of the support members 18, 20 not only provide a steady platform to support the vacuum cleaner 10 on a flat surface, they also provide stops that hold the wrapped cord in place.

Figure 2A:
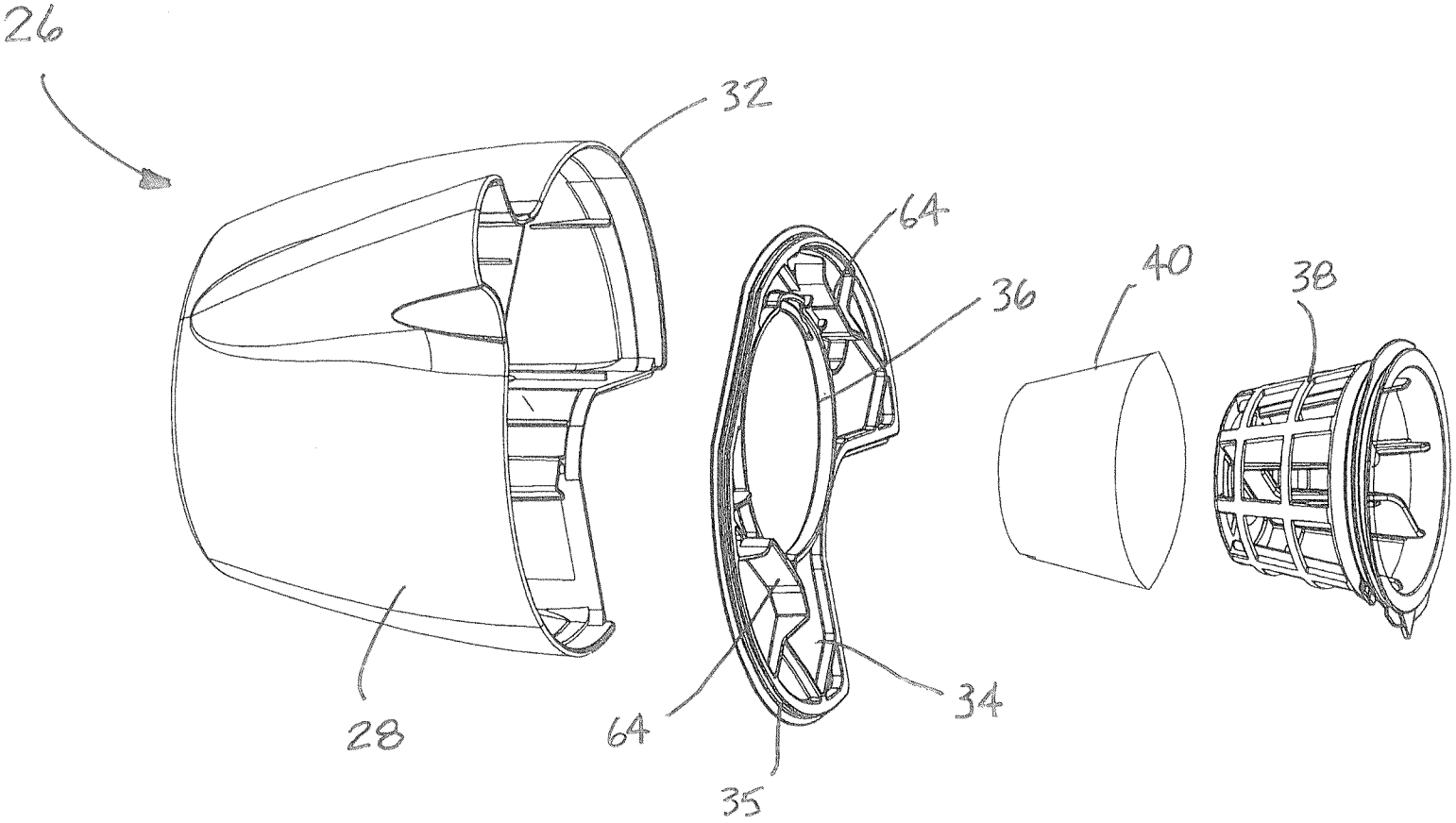
FIG. 2*a* is an exploded perspective view of the dirt collection vessel of the vacuum cleaner.
Figure 3:
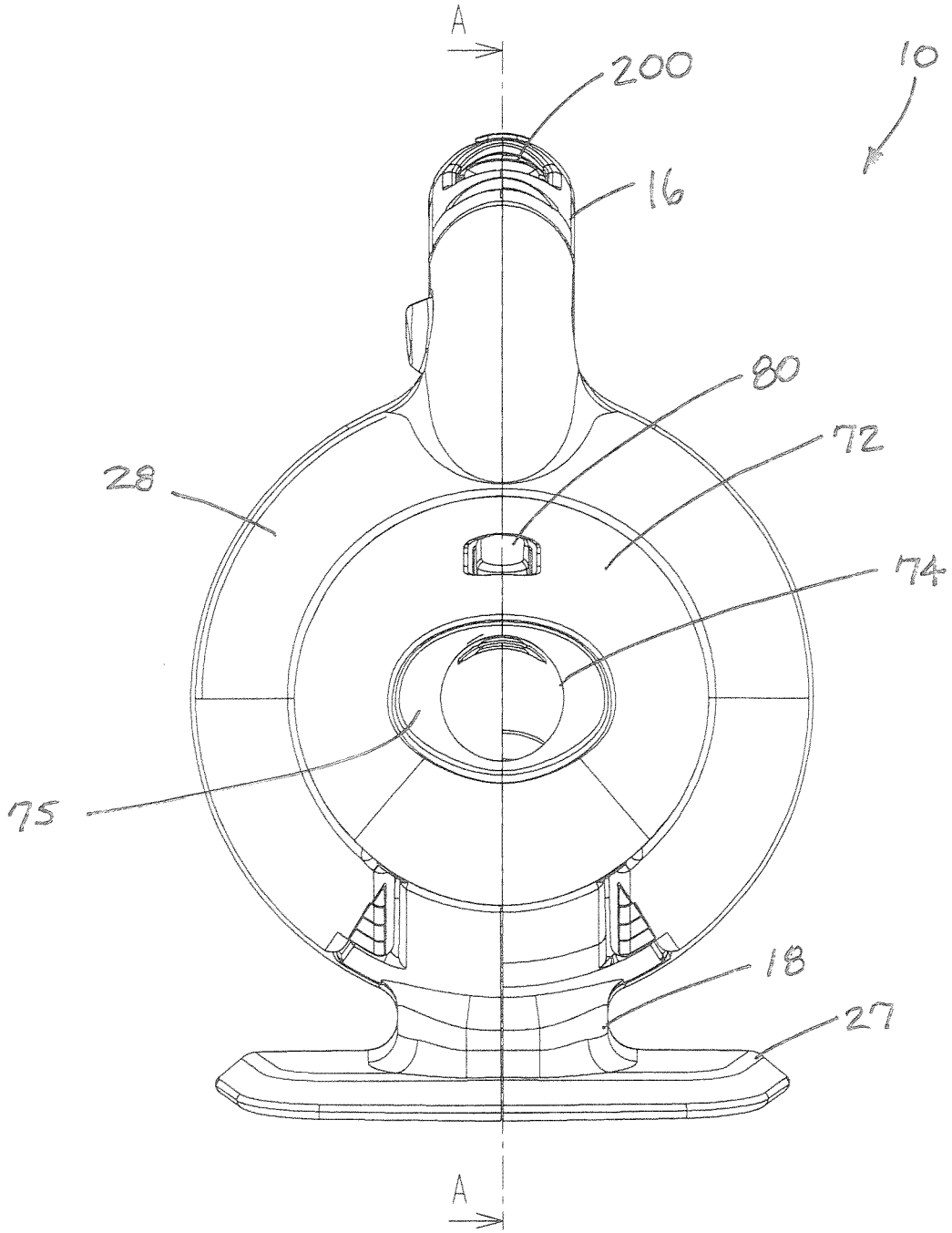
FIG. 3 is a front elevational view of the vacuum cleaner.
Figure 4A:
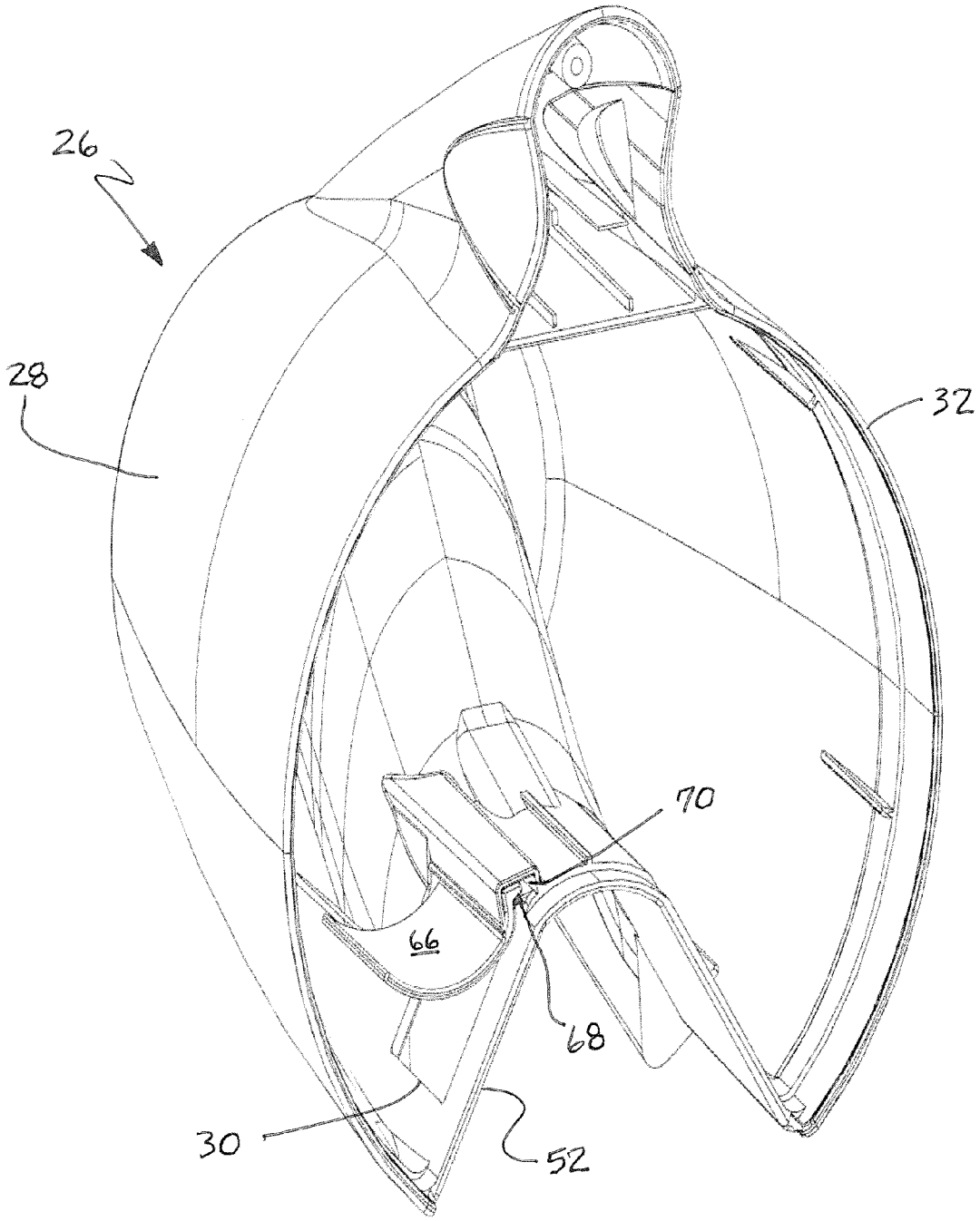
FIG. 4*a* is a rear perspective view of the open dirt cup illustrating the inlet port and flap valve.
Figure 4B:
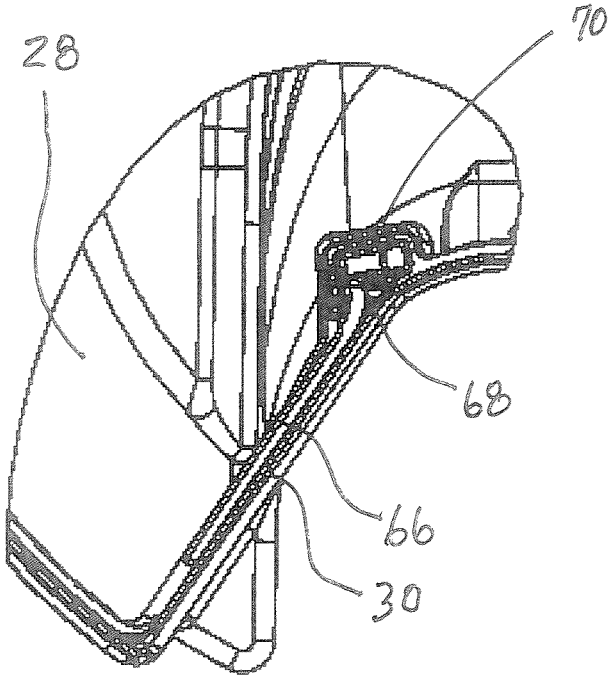
FIG. 4*b* is a detailed view of the flap valve.
Figure 5:
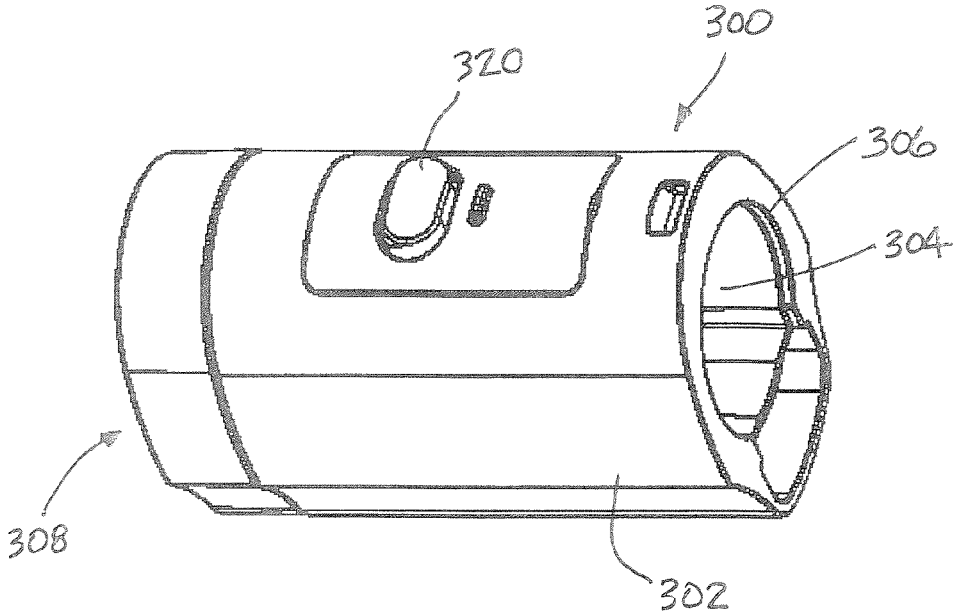
FIGS. 5, 5*a*, 5*b* and 5*c* are various detailed views of the vacuum cleaner adapter.
Figure 5A:
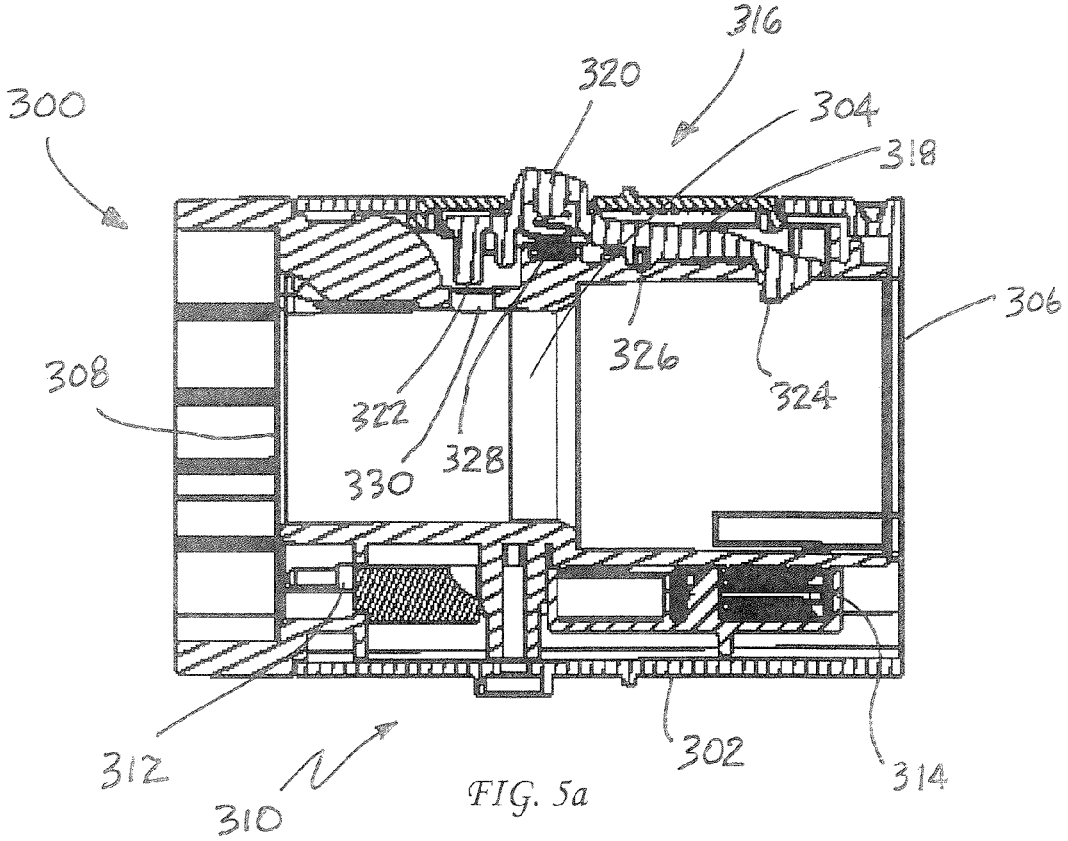
Figure 5B:
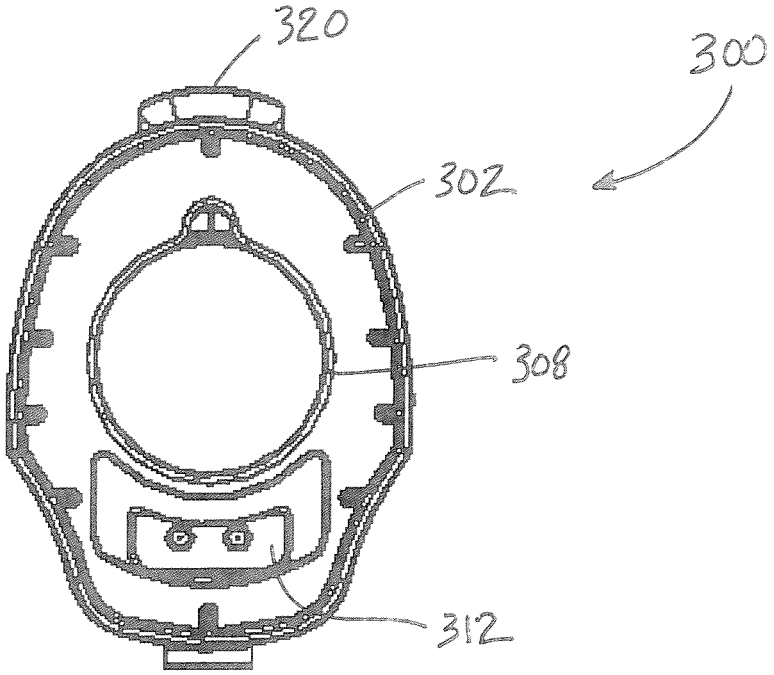
Figure 5C:
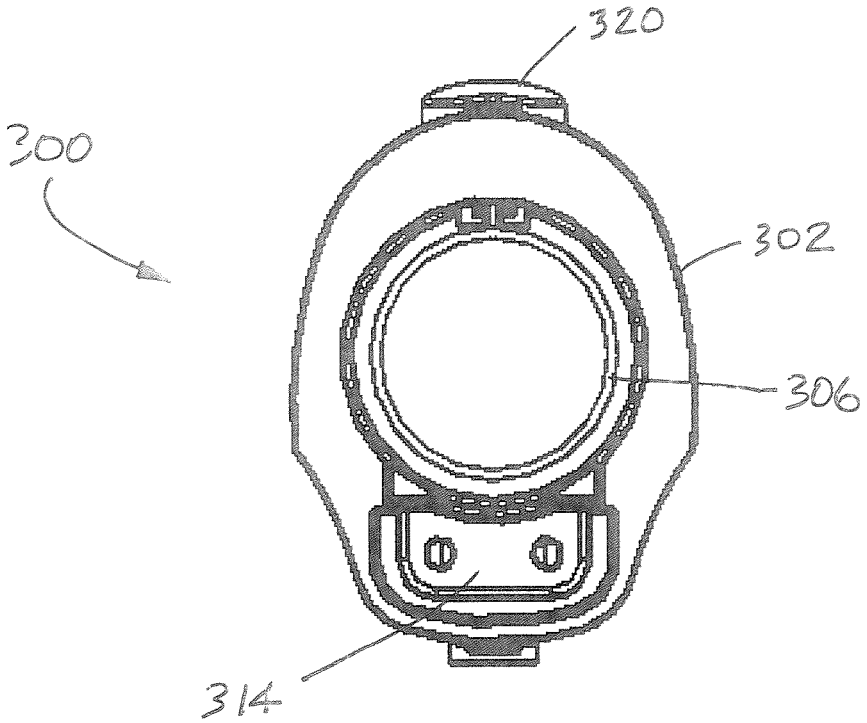

A dirt collection vessel, generally designated by reference numeral 26, is received and carried on the housing 12 (see also FIG. 2*a*). The dirt collection vessel 26 includes a dirt cup body 28 having an inlet port 30 and an opened end 32 which is closed by a removable wall 34 having an outlet port 36. A seal 35 carried on the wall 34 insures proper sealing between the wall and the dirt cup body 28. A frustoconically shaped filter support 38 received and releasably held in the outlet port 36 supports a filter media 40 that maintains dirt and debris in the dirt collection vessel 26 but allows clean air to be drawn toward the suction generator 24.

As further illustrated in the drawing figures, the housing 12 includes a spine section 42 that receives and holds a first, wand or male mechanical connector 44. A substantially S-shaped suction conduit 46 extends through the first connector 44 and the spine section 42 from the suction inlet 48 to the side-discharge, suction outlet 50.

The dirt collection vessel 26 includes a saddle portion 52 that is sized and shaped to be received over the spine section 42. A channel 54 in the front wall of the dirt cup body 28 receives a locating flange 56 on the spine section 42. A spring-loaded locking lever 58 engages an integrally molded latch (not shown) provided on the body 14 to lock the dirt collection vessel 26 on the housing 12 in the fully seated, operating position.

An actuator button 62 may be depressed to release the locking lever 58 and allow the dirt collection vessel 26 to be removed from the housing 12 for emptying. Specifically, spaced projections 64 on the removable wall 34 at opposite sides of the outlet port 36 are engaged by the fingers to remove the wall and open the dirt cup body 28 for emptying of dirt and debris. After emptying, the removable wall 34 is repositioned in the open end 32 of the dirt cup body 28 and the dirt collection vessel 26 is then repositioned in the fully seated position on the spine section 42 of the housing 12. There, the dirt collection vessel 26 is once again locked in position by the locking lever 58 for vacuum cleaning.

It should be appreciated that when the dirt collection vessel 26 is properly seated and locked in position on the housing 12, the suction outlet 50 of the suction conduit 46 is aligned with the inlet port 30 of the dirt collection vessel 26. A resilient rubber flap valve 66 normally closes the inlet port 30. However, when the suction generator 24 is energized and air entrained with dirt and debris is being drawn into the vacuum cleaner 10, the flap valve 66 is pulled open to allow passage of the air stream from the suction conduit 46 into the dirt collection vessel 26.

As illustrated, the flap valve 66 includes an integrally molded mounting lug 68. The mounting lug 68 is received in a mounting channel 70 provided on the interior wall of the dirt cup body 28 adjacent the inlet port 30. When properly mounted in the channel 70, the flap valve 66 includes a bend of between about 40 and about 50 degrees that functions with the durometer of the flap valve material (between about 70 and about 75 Shore A) to provide the necessary biasing force for the flap valve 66 to close the inlet port 30 when the suction generator 24 is de-energized. Accordingly, dirt and debris are maintained in the dirt cup body 28 and prevented from entering the suction conduit 46 when the suction generator 24 is not energized. Further, dirt and debris are prevented from exiting the dirt cup body 28 through the inlet port 30 when the dirt collection vessel 26 is removed from the housing 12 for emptying.

A nose tool 72 may be received over the first or male mechanical connector 44. The nose tool 72 includes a suction opening 74 having a flared sidewall 75 with a continuously variable radius. More specifically, the sidewall 75 defines a suction opening 74 that transitions smoothly from a substantially oval shape to a circular shape. The nose tool 72 allows one to perform various types of cleaning at different angles of attack while minimizing the possibility of the suction opening 74 completely sealing with the surface being cleaned.

The nose tool 72 may be easily installed onto the first or male connector 44 by sliding it on over the connector until a spring loaded detent 76 carried on the connector 44 is received in a cooperating aperture 78 provided in the nose tool 72. Once aligned, the detent 76 is biased into the aperture 78 to provide a positive connection. The nose tool 72 also carries an actuator 80 that may be depressed to force the detent 76 from the aperture 78 and thereby unlock the nose tool 72 for removal from the first or male connector 44 when desired. This is done, for example, when it is desired to connect the vacuum cleaner 10 to a cleaning attachment 100 such as a wand and nozzle assembly from a state of the art canister vacuum cleaner.

Figure 6:
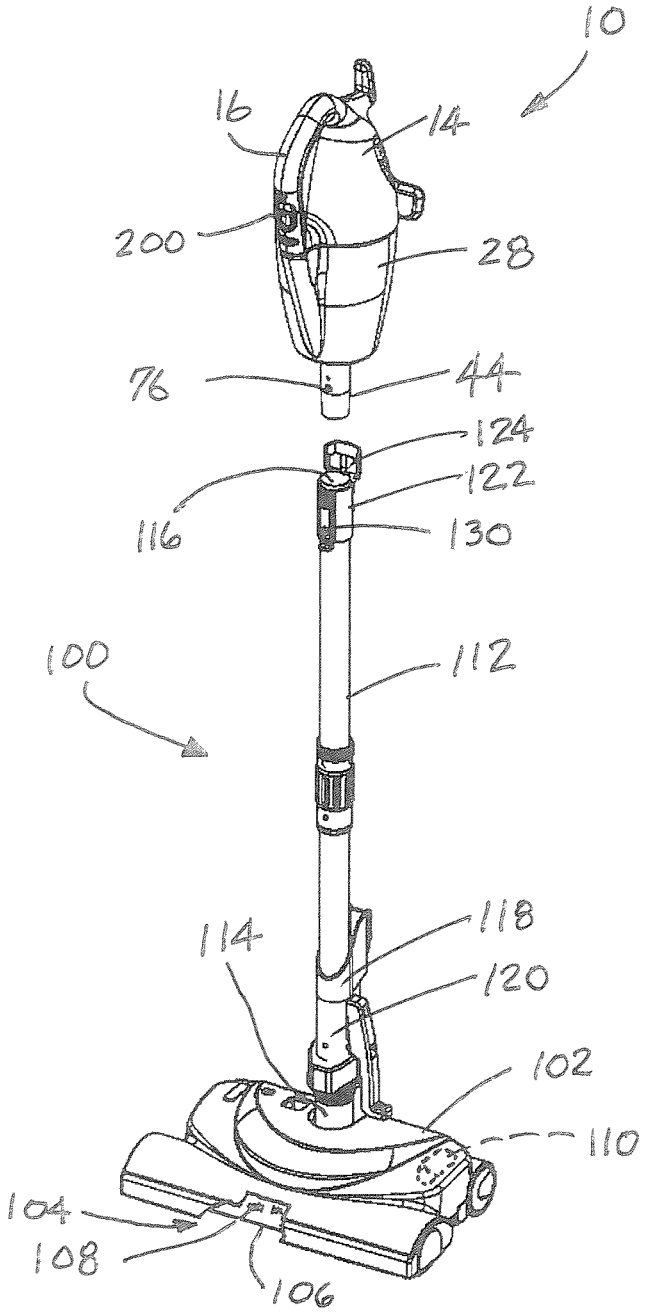
FIG. 6 is an exploded perspective view of the vacuum cleaner and a state-of-the-art wand and nozzle assembly equipped with a female mechanical connector.
Figure 7:
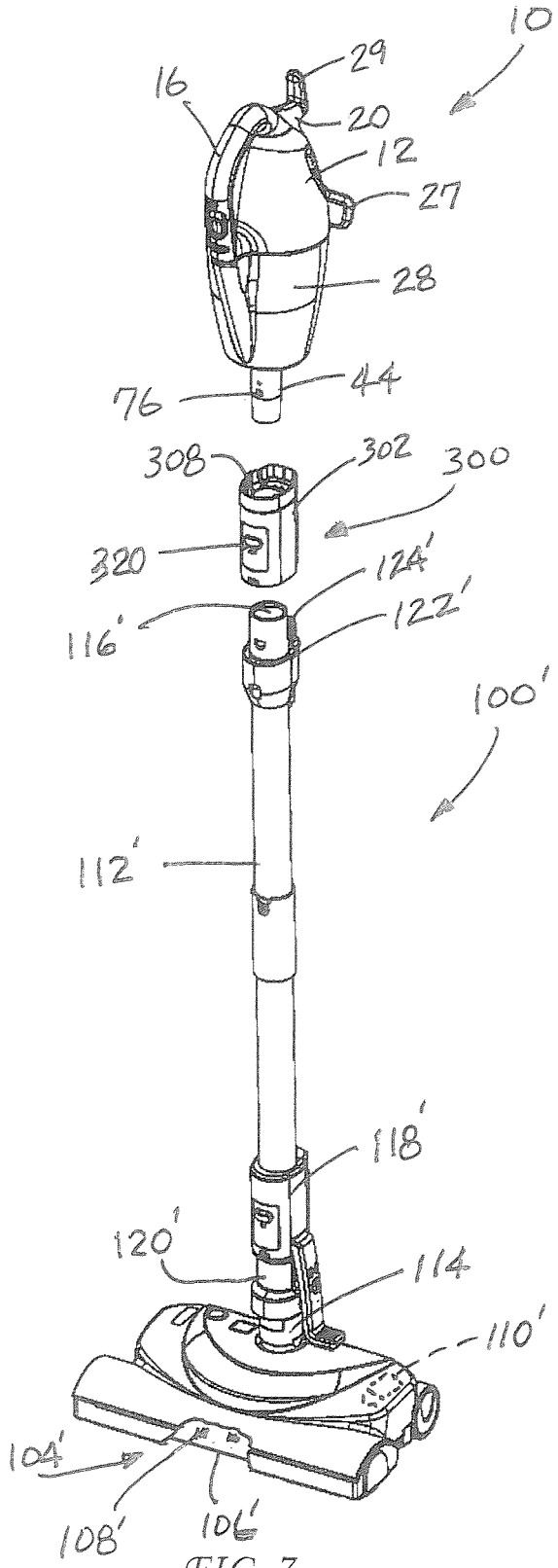
FIG. 7 is an exploded perspective view of the vacuum cleaner with adapter and state-of-the-art wand and nozzle assembly equipped with a male mechanical connector.

As best illustrated in FIG. 6, such a state of the art wand and nozzle assembly 100 includes a nozzle assembly 102 having an agitator cavity 104 holding a rotary agitator 106 including bristle tufts 108 or other cleaning projections. The rotary agitator 106 is driven at high speeds during the cleaning operation in order to beat dirt and debris from the nap of an underlying carpet being cleaned. Typically the rotary agitator 106 is driven by an agitator drive motor 110 carried on the nozzle assembly 102. An elongated extension wand 112 is pivotally connected to the nozzle assembly 102. The agitator cavity 104 is provided in fluid communication with a suction inlet 114 in the nozzle assembly 102. The suction inlet 114 is in turn connected in fluid communication with an interior suction passageway 116 that extends through the length of the wand 112. A combined mechanical and electrical connector 118 connects one end of the wand 112 to a cooperating mechanical and electrical connector 120 carried by the nozzle assembly 102. A second mechanical and electrical connector 122 is provided at the end of the wand 112 opposite the nozzle assembly 102.

In one embodiment of the present invention illustrated in FIG. 6, the connector 122 provides for female mechanical connection. In this embodiment the vacuum cleaner 10 may be connected directly to the connector 122 of the cleaning attachment 100. In order to do this, the nose tool 72 is removed and the male mechanical connector 44 is plugged directly into the mechanical and electrical connector 122. The male mechanical connector 44 also includes an electric terminal 45 that is aligned with and engages the electric terminal 124 of the connector 122. When the connectors 44, 122 and terminals 45, 124 are fully connected, the spring loaded detent 76 engages in a cooperating locking aperture (not shown) provided on the connector 122. Accordingly, the vacuum cleaner 10 is securely locked to the cleaning attachment 100.

When the vacuum cleaner 10 is locked in this position, the operator can use the control handle 16 to manipulate the cleaning attachment 100. Further, the vacuum cleaner 10 provides complete control of the rotary agitator 106 of the cleaning attachment 100. More specifically, a three position switch 200 is provided on the control handle 16 of the vacuum cleaner 10. In the first, off position, all electrical systems are de-energized. In the second or bare floor cleaning position, electrical power is provided only to the suction generator 24. No electrical power is provided to the rotary agitator drive motor 110. Accordingly, the rotary agitator 106 remains stationary to allow for enhanced bare-floor cleaning as the operator uses the control handle 16 to manipulate the cleaning attachment 100 back and forth across the floor being cleaned.

In the third position, the actuator switch 200 energizes both the suction generator 24 of the vacuum cleaner 10 and the agitator drive motor 110 of the cleaning attachment 100. Thus, in this position the rotary agitator 106 is driven to beat dirt and debris from the nap of an underlying carpet being cleaned. That dirt and debris is then drawn into the vacuum cleaner 10 by the negative pressure produced by the suction generator 24. More specifically, an air stream is drawn through the agitator cavity 104 into the suction inlet 114 of the nozzle assembly 102. From there, the air stream, with entrained dirt and debris, is drawn through the suction passageway 116 in the extension wand 112 and then through the suction conduit 46 of the vacuum cleaner 10. Next the air moves through the inlet port 30 past the open flap valve 66 into the dirt cup body 28 of the dirt collection vessel 26. Dirt and debris are trapped inside the dirt cup body 28 while relatively clean air is drawn through the filter media 40 on the filter support 38 mounted in the outlet port 36. The air stream then passes through a secondary filter (not shown) before being drawn into the suction generator 24. Next the airstream passes through the compartment 22 before being exhausted into the environment through the exhaust ports 204.

After completing the cleaning application, the vacuum cleaner 10 may be detached from the cleaning attachment 100 by depressing a release button 130 provided on the connector 122. More specifically, the release button 130 forces the spring loaded detent 76 from the locking aperture in order to allow disconnection.

While the cleaning attachment 100 included a connector 122 with a female mechanical connector, it should be appreciated that some state-of-the-art cleaning attachments 100' include a male mechanical connector 122'. The first, male mechanical connector 44 of the vacuum cleaner 10 is not compatible with a cleaning attachment 100' incorporating a male mechanical connector. In order to address this situation, the present invention also includes an adapter 300. As best illustrated in FIGS. 1 and 5, 5*a*, 5*b* and 5*c* the adapter 300 includes a body 302 and an air flow passageway 304 extending through the body and having first and second ends 306, 308 respectively. An electrical power supply circuit 310 includes a first terminal 312 and a second terminal 314. In the illustrated embodiment, the first terminal 312 is a male electrical connector while the second terminal 314 is a female electrical connector. It should be appreciated, however, that the first terminal and second terminal may be of any configuration appropriate for an electric terminal.

A locking assembly, generally designated by reference numeral 316, secures the adapter 300 to the first male mechanical connector 44 and the mechanical connector 122' of a second, alternative cleaning attachment 100' where that connector 122' is a male mechanical connector. More specifically, the locking assembly 316 comprises a latch lever 318 that includes an actuator 320, a lug 322 and a locking tab 324. A pivot pin 326 mounts the latch lever 318 to the adapter 300. A spring 328 engages the latch lever 318 and biases the latch lever into a first position wherein the adapter 300 is positively secured to the first connector 44 and the connector 122' of the second cleaning attachment 100'. When the actuator 320 is depressed, the latch lever 318 is pivoted into a second position wherein the adapter 300 is released from positive attachment with both the first connector 44 and the second cleaning attachment 100'.

The use of the vacuum cleaner 10 with the optional adapter 300 will now be described in detail. When it is desired to connect the vacuum cleaner 10 to a cleaning attachment 100' including a male mechanical connector 122' on the end of the wand 112', the adapter 300 is positioned over the connector 44. When fully seated on the connector 44, the spring loaded detent 76 of the connector 44 engages in a cooperating locking aperture 330 provided in the body 302. At the same time the first terminal 312 on the adapter 300 fully engages and connects with the electric terminal 45 carried on the connector 44.

With the adapter 300 in position on the connector 44, the vacuum cleaner 10 may now be connected to the connector 122' of the cleaning attachment 100'. More specifically, the connector 122' is inserted into the first end 306 of the adapter 300 so that the electric terminal 124' properly engages and connects to the second terminal 314 and the locking tab 324 on the latch lever 318 engages in a cooperating locking aperture (not shown) on the connector 122'. More specifically, the spring 328 ensures that the locking tab 324 is biased into the locking position.

When properly connected, the operator may utilize the control handle 16 of the vacuum cleaner 10 to manipulate the cleaning attachment 100' as needed to complete the cleaning task. The operator may utilize the three position switch 200 to selectively energize both the suction generator 24 of the vacuum cleaner 10 and the motor 110' that drives the rotary agitator 106' to clean an underlying carpet. Alternatively, the operator may position the three position switch for bare floor cleaning with only the suction generator 24 being energized and electrical power being interrupted to the agitator drive motor 110'. In the third position, both the suction generator 24 and the agitator drive motor 110' may be turned off. Once cleaning is completed, the operator may depress the actuator 320 to simultaneously withdraw the locking tab 324 from the locking aperture (not shown) of the connector 122' and force the spring loaded detent 76 from the locking aperture 330 in the adapter 300. Thus, it should be appreciated that the adapter 300 allows the operator to disconnect the actuator from both the cleaning attachment 100' and the vacuum cleaner 10 as desired.

In summary, numerous benefits result from employing the concepts of the present invention. The vacuum cleaner 10 functions as a high-powered hand-held vacuum cleaner with strong suction power between about 63.5 and about 74.5 inches of water. Since the vacuum cleaner 10 is plugged into and runs on electrical power from a standard wall outlet, the power is sustainable for extended periods of operating time versus typical battery powered hand-held units.

Not only is the vacuum cleaner 10 a stand alone unit but it may be attached to various cleaning attachments including, but not limited to, wand and nozzle assemblies 100, 100' of state-of-the-art canister vacuum cleaners. This includes vacuum cleaners currently in production as well as many of those produced in the past. Thus, the vacuum cleaner 10 may be retrofit to a wand and nozzle assembly of a state-of-the-art canister vacuum cleaner in order to provide a stick-type vacuum for various cleaning operations. Accordingly, the vacuum cleaner 10 of the present invention provides tremendous versatility and enhances the functionality of older, previously purchased equipment.

The suction conduit 46, including the suction inlet 48 and side-discharge outlet 50, and the suction generator 24 are not mounted on a common centerline. The suction generator 24 is mounted below the centerline A so as to be offset toward the support member 18, 20. Further, as noted above, the suction conduit 46 is substantially S-shaped. This allows the vacuum cleaner 10 to be made more compact. It also provides for better weight distribution that effectively improves: (1) the stability of the vacuum cleaner 10 when supported on the support members 18, 20; (2) the balance of the vacuum cleaner when it is manipulated during cleaning; and (3) the stability of the combined vacuum cleaner and wand and nozzle assembly 100, 100' when the wand is in the upright or storage position.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A hand-held and conversion vacuum cleaner, comprising:

a housing;

a suction generator carried on said housing;

a dirt collection vessel carried on said housing;

a suction inlet carried on said housing;

a first connector carried on said housing, said first connector adapted for securing said suction inlet in fluid communication with a first cleaning attachment; and an adapter that is optionally secured to said first connector, said adapter including a second connector for securing said suction inlet in fluid communication with a second cleaning attachment, said adapter including (a) a body, (b) an airflow passageway extending through said body and having a first end and a second end and (c) an electrical power supply circuit including a first terminal and a second terminal.

2. The vacuum cleaner of claim 1, wherein said first terminal is a male electrical connector and said second terminal is a female electrical connector.

3. The vacuum cleaner of claim 1, including a locking assembly for securing said adapter to said first connector and said second cleaning attachment.

4. The vacuum cleaner of claim 3, including an actuator on said adapter for releasing said locking assembly.

5. The vacuum cleaner of claim 4, wherein said first connector is a male mechanical connector and said second connector is a female mechanical connector.

6. A hand-held and conversion vacuum cleaner comprising:

a housing;

a suction generator carried on said housing;

a dirt collection vessel carried on said housing;

a suction inlet carried on said housing;

a first connector carried on said housing, said first connector adapted for securing said suction inlet in fluid communication with a first cleaning attachment; and an adapter that is optionally secured to said first connector, said adapter including a second connector for securing said suction inlet in fluid communication with a second cleaning attachment;

wherein said first connector is a male mechanical connector including a spring-loaded locking detent.

7. The vacuum cleaner of claim 6, wherein said second connector is a female mechanical connector.

8. The vacuum cleaner of claim 7, wherein said adapter includes a first locking aperture for receiving said spring loaded detent when said adapter is seated on said first connector.

9. The vacuum cleaner of claim 8, wherein said adapter includes a latch lever having (a) a first position wherein said adapter is positively secured to said first connector and said second cleaning attachment and (b) a second position wherein said adapter is released from positive attachment with said first connector and said second cleaning attachment.

10. The vacuum cleaner of claim 9, wherein said latch lever includes an actuator, a lug and a locking tab.

11. The vacuum cleaner of claim 10, wherein said latch lever is mounted by a pivot pin to said adapter and said latch lever is spring-loaded so as to be biased into said first position.

12. The vacuum cleaner of claim 11, wherein said spring-loaded detent engages in said first locking aperture and said locking tab engages in a second locking aperture in said second cleaning attachment when said latch lever is in said first position.

13. The vacuum cleaner of claim 11, wherein said lug displaces said spring-loaded detent from said first locking aperture and said locking tab is withdrawn from said second locking aperture when said latch lever is in said second position.

14. A hand held and conversion vacuum cleaner, comprising:

a housing;

a suction generator carried on said housing;

a dirt collection vessel carried on said housing;

a suction inlet carried on said housing;

a first connector carried on said housing, said first connector adapted for securing said suction inlet in fluid communication with a first cleaning attachment; and an adapter that is optionally secured to said first connector, said adapter including a second connector for securing said suction inlet in fluid communication with a second cleaning attachment;

further including a nose tool connected to said first connector when said adaptor is not in use.

15. The vacuum cleaner of claim 1, wherein said housing includes a suction conduit extending from said dirt collection vessel through said first connector.

16. The vacuum cleaner of claim 15, wherein said suction conduit is substantially S-shaped.

17. A hand held and conversion vacuum cleaner, comprising:

a housing;

a suction generator carried on said housing;

a dirt collection vessel carried on said housing;

a suction inlet carried on said housing;

a first connector carried on said housing, said first connector adapted for securing said suction inlet in fluid communication with a first cleaning attachment; and an adapter that is optionally secured to said first connector, said adapter including a second connector for securing said suction inlet in fluid communication with a second cleaning attachment;

wherein said housing includes a three position electrical switch for (a) selectively energizing said suction generator alone, (b) selectively energizing said suction generator and any electrical component carried on said first or second cleaning attachment and (c) selectively de-energizing said suction generator and any electrical component carried on said first or second cleaning attachment.

18. A method of converting a hand-held vacuum cleaner to a stick vacuum cleaner wherein said hand-held vacuum cleaner includes a housing, a suction generator and a dust collection vessel, said method comprising:

providing said hand-held vacuum cleaner with a first connector structured to engage and connect with a first type of mating connector on a first cleaning wand;

providing said hand-held vacuum cleaner with a second connector structured to engage and connect with a second type of mating connector on a second cleaning wand; and connecting said hand-held vacuum cleaner to said first cleaning wand or said second cleaning wand in order to convert said hand-held vacuum cleaner to a stick vacuum cleaner.

19. The method of claim 18, including:

providing said second connector on an adapter; and connecting said adapter to said first connector.

* * * * *